US006213633B1

(12) United States Patent
Kramer et al.

(10) Patent No.: US 6,213,633 B1
(45) Date of Patent: Apr. 10, 2001

(54) MIXING AND DISPENSING DEVICE

(75) Inventors: Hans Kramer, Baden; Willi Lorscheidt, Pulheim, both of (DE)

(73) Assignee: SmithKline Beecham Consumer Healthcare GmbH, Buhl (DE)

( * ) Notice: Subject to any disclaimer, the term of this patent is extended or adjusted under 35 U.S.C. 154(b) by 0 days.

(21) Appl. No.: 09/202,234

(22) PCT Filed: Jun. 9, 1997

(86) PCT No.: PCT/EP97/03052

§ 371 Date: Jun. 10, 1999

§ 102(e) Date: Jun. 10, 1999

(87) PCT Pub. No.: WO97/47378

PCT Pub. Date: Dec. 18, 1997

(30) Foreign Application Priority Data

Jun. 11, 1996 (GB) ..... 96304357

(51) Int. Cl.[7] ..... B01F 5/00

(52) U.S. Cl. ..... 366/339; 366/181.5; 366/177.1; 222/137; 222/145.6

(58) Field of Search ..... 366/336, 339, 366/338, 340, 341, 342, 174.1, 175.2, 165.2, 89, 181.5, 177.1; 222/137, 145.6

(56) References Cited

U.S. PATENT DOCUMENTS

| | | | | |
|---|---|---|---|---|
| Re. 26,147 | * | 1/1967 | Parshall et al. | 366/80 |
| 2,512,471 | * | 6/1950 | Trist | 366/339 |
| 2,639,464 | * | 5/1953 | Magerkurth | 366/80 |
| 4,088,449 | * | 5/1978 | Smith | 366/339 |
| 4,438,871 | * | 3/1984 | Eckert | 222/137 |
| 4,767,026 | * | 8/1988 | Keller et al. | 366/339 |
| 5,104,004 | | 4/1992 | von Schuckmann | 222/135 |
| 5,178,458 | | 1/1993 | Hsu | 366/89 |
| 5,421,650 | * | 6/1995 | Meyer | 366/339 |
| 5,694,833 | * | 12/1997 | Wenger | 366/89 |

FOREIGN PATENT DOCUMENTS

| | | | |
|---|---|---|---|
| 296 08 289 | | 8/1996 | (DE) . |
| 0 212 290 | | 3/1987 | (EP) . |
| 0 301 974 | | 2/1989 | (EP) . |
| 0 603 492 | | 6/1994 | (EP) . |
| 2 597 365 | | 10/1987 | (FR) . |
| 2 146 912 | * | 5/1985 | (GB) 366/339 |
| 2 292 531 | | 2/1996 | (GB) . |

* cited by examiner

*Primary Examiner*—Tony G. Soohoo
(74) *Attorney, Agent, or Firm*—Nora Stein-Fernandez; Stephen Venetianer; Charles M. Kinzig

(57) ABSTRACT

A mixing device for fluids, comprising a column within which there is an internal core, a space between the column and core defining a channel for the flow of the fluids, the surface of the column facing the core having fluid guide elements which impart helical flow in a first twist direction upon a fluid flowing along the channel, the surface of the core having fluid guide elements thereon which impart helical flow in an opposite twist direction upon the fluid. On part of the channel, the helical flow imparted to the fluid is predominantly in the twist direction of the elements on the core and on a part of the channel upstream or downstream of this part the helical flow imparted to the fluid is predominantly in the twist direction of the elements on the column.

9 Claims, 3 Drawing Sheets

MIXING AND DISPENSING DEVICE

FIELD OF THE INVENTION

This invention relates to a mixing device for mixing two or more fluid materials. The invention also relates to a dispensing device for two or more fluid materials incorporating the mixing device so as to mix the fluid materials upon dispensing.

BACKGROUND OF THE INVENTION

Various mixing devices for fluid materials are known. One general type of mixing device comprises a generally tubular column along which the two or more fluid materials are caused to flow together, the tubular column having internal turbulence-creating elements which engage with and cause turbulence in the flow of fluid materials along the column. The turbulence causes the materials to mix thoroughly. One such mixing device is disclosed in U.S. Pat. No. 4,767,026, which comprises a tubular column within which are a number of baffles in the form of helically twisted ribbons, the ribbons alternating in their direction of helical twist along the length of the column. The mixing device of U.S. Pat. No. 4,767,026 is disclosed in combination with a dispensing device for two fluid materials. Another such mixing device is disclosed in EP 0212290 A which comprises a cylindrical passage tube provided with a groove on its inner peripheral wall and a shaft with a helical groove on its outer peripheral surface. The grooves on the shaft and the passage tube are of unchanging depth along the length of the tube.

Known mixing devices are inadequate for the thorough mixing of certain materials, e.g. medicinal or other healthcare formulations which comprise two or more fluid materials each of which contain substances which are intended to interact on mixing to form a product.

It is an object of this invention to overcome this problem, in part at least, and also to provide an alternative to known mixing devices. It is also an object of the present invention to provide a mixing device which is suitable for use with the type of small volume hand operated dispensing devices often used for healthcare products, such as toothpastes, gels etc. These generally comprise a number of reservoirs for the respective substances each reservoir communicating with a hand operated pump which pumps the substance through a respective communicating dispensing outlet. Such dispensing devices are well known, for example in U.S. Pat. Nos. 5,104,004 and 4,438,871 among many others. Other objects and advantages of the present invention will be apparent from the following description.

SUMMARY OF THE INVENTION

Accordingly, this invention provides a mixing device which is suitable for mixing two or more fluid materials; comprising a generally tubular column, within the column there being an internal longitudinally aligned core, with a space between the column and the core defining a channel which is suitable for the flow of the fluid materials in an overall longitudinal direction through the column, the channel having an inlet end and an outlet end for the respective inlet and exit of fluid material into and out of the channel, the inner surface of the column which faces the core having one or more fluid guide elements thereon which impart helical flow in a first twist direction upon a fluid flowing longitudinally along the channel from the inlet end to the outlet end, and the outer surface of the core which faces the column having one or more fluid guide elements thereon which impart helical flow in a second twist direction opposite to the first twist direction upon a fluid flowing longitudinally along the channel from the inlet end to the outlet end, characterised in that:

in part of the channel the helical flow imparted to the fluid is predominantly in the twist direction of the guide elements on the core and in a part of the channel upstream or downstream of this part the helical flow imparted to the fluid flow is predominantly in the twist direction of the guide elements on the column.

BRIEF DESCRIPTION OF THE DRAWINGS

The invention will now be described by way of non-limiting example only with reference to the following drawings.

DETAILED DESCRIPTION OF THE INVENTION

Figure 1:
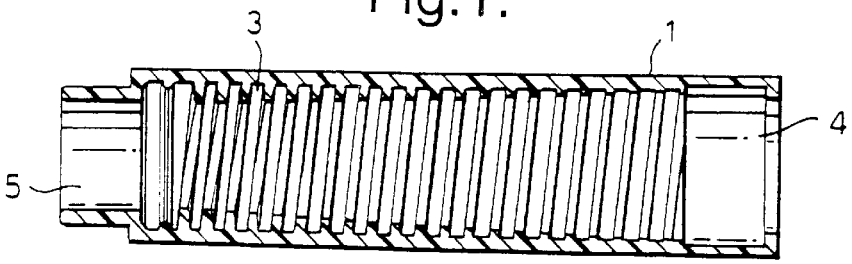
FIG. 1 shows a longitudinal cross sectional view through the column of a mixing device of this invention.

In a preferred embodiment the tubular column is internally generally circular-sectioned, and the core is preferably also externally generally circular-sectioned, with the core coaxially aligned with the column. The axes of the said helical twists are suitably those of the column and core.

Preferably toward the inlet end of the channel the helical flow imparted to the fluid is predominantly in the twist direction of the guide elements on the core, and downstream of the inlet end, i.e toward the outlet end, the helical flow imparted to the fluid flow is predominantly in the twist direction of the guide elements on the column.

The said fluid guide elements may be of various types, e.g. aligned elements, e.g. helically or part-helically aligned elements such as one or more of baffles, vanes, ridges or grooves etc., or combinations thereof upon the respective surfaces of the column and the core.

In a preferred embodiment, the said fluid guide elements comprise one or more helical grooves in the surface of the column which faces the core, and one or more helical grooves in the surface of the core which faces the column, the helical axes of the one or more grooves being generally longitudinal, and the relative twist directions of the one or more helical grooves on the column and core being opposite.

The said grooves may be present as cuts into the surfaces of the column and/or core, or may be present between ridges raised from these surfaces.

In this preferred embodiment the one or more grooves on the column and the core are in communication at their upper open faces and form a convoluted channel between the inlet and the outlet of the channel. The parts of the surface of the core and column, or the said ridges between the grooves on respectively the core and the column, may be in contact.

The one or more grooves in the surface of the column and the core are suitably continuous unbroken grooves. A single groove in the surface of the column and in the surface of the core may be used, or alternatively there may be multiple grooves.

In this preferred embodiment the depth of the one or more grooves in the column varies so as to be greater in the vicinity of the outlet end of the column than in the vicinity[] of the inlet end. Suitably the depth of the one or more grooves in the column may gradually increase from the inlet end toward the outlet end. In this embodiment the depth of the one or more grooves in the surface of the core may vary so as to be greater in the vicinity of the inlet end of the column than in the vicinity of the outlet end. Suitably the depth of the one or more grooves in the core may gradually decrease from the inlet end toward the outlet end. In this preferred embodiment therefore, at the inlet end of the column deeper grooves on the core face shallower grooves on the column, and toward the outlet end of the column shallower grooves on the core face deeper grooves on the column. This variation in the depth of the grooves in the core and column may occur gradually along the length of the column, or alternately the variation in depth may be stepwise along the length of the column.

In another preferred embodiment the internal cross section of the column decreases, e.g gradually tapers or decreases step-wise from the inlet end toward the outlet end, so that .internally the column is wider at the inlet end than at the outlet end, and the external cross section of the core also decreases in a manner generally corresponding to the decrease in internal cross section of the column. The column and core may consequently be of a generally conical or frustro-conical shape, which may have a longitudinally straight, concave curved, convex curved, or stepped, sided shape.

Preferably, in a column which decreases in internal diameter with length as described above the depth of the one or more grooves may gradually increase in a way corresponding to the decrease in internal diameter with length of the column, so that for example the bottom of the one or more grooves lie at the same level, e.g. in a cylindrical surface. Preferably, in a tapering core as described above the depth of the one or more grooves may gradually decrease in a way corresponding to the taper of the core, such that for example the bottom of the one or more grooves lie at the same level, e.g. in a cylindrical surface.

The profile, width and helical pitch of the said grooves may also differ at different places on the column and core. A suitable profile, helical pitch and dimensions for the above described helically aligned guide elements, e.g. the said grooves, for any particular application will be apparent to those skilled in the art or may be determined by simple experimentation. A suitable cone angle for the above-mentioned tapering core and column is 1°–4° particularly 2°–4°.

Although in the above described preferred embodiment the variation in depth of the groove(s) on the core is such that the groove(s) is/are deeper toward the inlet end of the core and the variation in depth of the groove(s) on the column is such that the groove(s) is/are deeper toward the outlet end of the column, the reverse embodiment is also included within the invention, i.e the variation in depth of the groove(s) on the core being such that the groove(s) is/are deeper toward the outlet end of the column and the variation in depth of the groove(s) on the column being such that the groove(s) is/are deeper toward the inlet end of the column.

At the inlet end of the column the two or more fluids may be fed into the column in separate streams, which may for example be side-by-side, coaxial, or radially segmented streams. Alternatively the fluids may be partly pre-mixed, for example by causing separate streams of the fluids to flow into a pre-mixing region upstream of the column. Suitable dispensing devices with dispensing columns to achieve this are known in the art. At the inlet and/or outlet end the column may be provided with a filter device or other device to modify the characteristics of the stream of mixed fluid.

The column and core may be made by simple injection moulding techniques, for example of moulded plastics materials such as polypropylene, nylon etc. The column and core of the mixing device of the invention may each be of integral construction or one or each may be made of two or more part construction. For example the column may be made as a shell and a separate core may be inserted therein, and retained in place by suitable means such as snap-fit etc. which will be apparent to those skilled in the art. The mixing device of the invention may be made as a separate nozzle-like extension or adapter for attachment to the outlet passages of a dispenser for two or more fluid materials of the kind discussed above.

The invention also provides a dispensing device for two or more fluid materials incorporating the mixing device as described above to mix the fluid materials therein upon dispensing them.

Such a dispensing device may comprise two or more respective reservoirs suitable to contain the two or more fluid materials, each reservoir being provided with displacement means to transfer material from the reservoir through an outlet opening in each reservoir, into the inlet end of the mixing device.

The dispensing device may comprise two or more separate storage reservoirs each reservoir containing respective fluid material; each reservoir being in the form of a cylinder, each reservoir having a respective outlet passage and a piston moveable internally along the cylinder to force the material out through the outlet passage of the reservoir, and a mixing device as described above in downstream communication with the outlet passage of each reservoir and from which the product is dispensed.

The dispensing device may alternatively comprise two or more collapsible reservoirs, e.g. plastics material or metal foil or laminate tubes, each reservoir containing respective fluid material, each reservoir having a respective outlet passage which is respectively in downstream communication a mixing device as described above in downstream communication with the outlet passages and from which the product is dispensed.

The dispensing device may alternatively comprise two or more separate storage reservoirs containing the respective two or more fluid materials; two or more hand-operable pumps respectively in communication with said two or more separate storage reservoirs and capable of pumping the fluid material therein from the reservoirs and alone two or more respective separate outlet passages which are respectively in downstream communication with the pumps, and a mixing device as described above in downstream communication with the outlet passages and from which the product is dispensed.

The dispensing device of the invention may be made of plastics materials. The dispensing device may be provided with appropriate closures to prevent leakage or contamination, and these may be tamper evident. The dispensing device may be provided with appropriate locking mechanisms to prevent premature operation of pistons or pumps etc.

The mixing device of the invention provides an improved mixing effect by virtue of the fact that considerable turbulence and shear is caused in the stream of fluids flowing through the channel by the simultaneous imparting of opposite helically twisted flow to the fluids. This is achieved in a more simple manner in the mixing device of the invention than in the device of for example U.S. Pat. No. 4,767,026, in that only one core element need be used instead of the several "ribbons" of U.S. Pat. No. 4,767,026. Also improved mixing is achieved over the mixing device of EP 0212290 A because of the shear and turbulence caused because in part of the channel the helical flow imparted to the fluid is predominantly in the twist direction of the guide elements on the column and at a part of the channel upstream or downstream of this part the helical flow imparted to the fluid flow is predominantly in the twist direction of the guide elements on the core.

Figure 2:
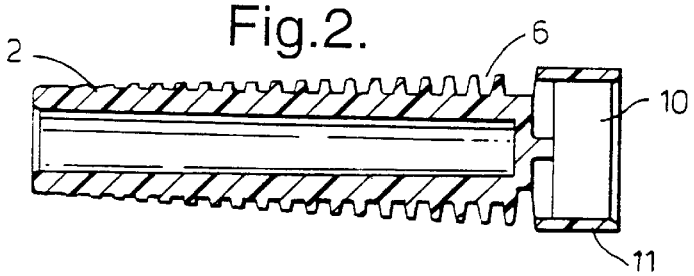
FIG. 2 shows a longitudinal cross sectional view through the core of a mixing device of this invention.
Figure 3:
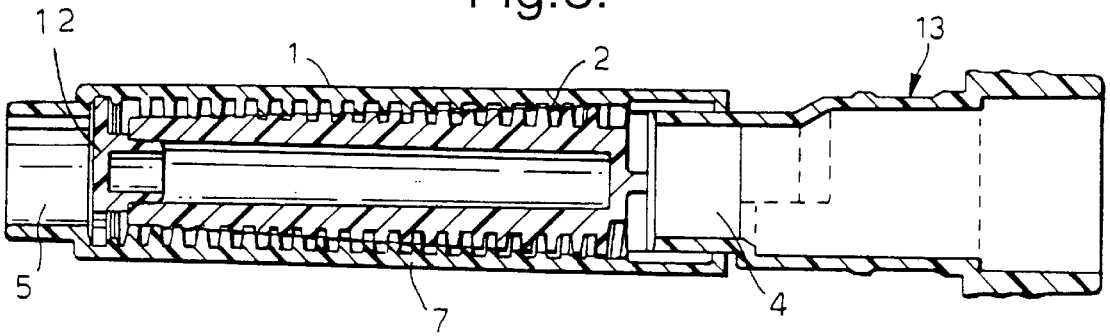
FIG. 3 shows a longitudinal cross sectional view through a mixing device of this invention having the core of FIG. 2 in place of the column of FIG. 1.

Referring to FIGS. 1, 2, 3 and 4, a mixing device which is suitable for mixing two or more fluid materials comprises a generally tubular column (1). Within the column (1) as shown in FIG. 3 there is an internal core (2) longitudinally aligned with the tube axis of the column 1. In FIG. 2 the core (2) is shown independently of the column (1). The tubular column (1) is internally generally circular-sectioned, and the core (2) is also externally generally circular-sectioned, and when in place as shown in FIG. 3 the core (2) is coaxially aligned with the column (1).

In the internal surface of the column (1), which faces the core (2) when this is in place as shown in FIG. 3, is a continuous unbroken helical groove (3), running from the inlet end (4) of the column (1) to the outlet end (5) of the column (1). In the surface of the core (2), which when the core (2) is in place in the column (1) as shown in FIG. 3 faces the column (1), is a continuous unbroken helical groove (6) running from the inlet end (4) of the core (2) to the outlet end (5) of the core (2). The helical axes of the grooves (3), (6) is generally longitudinal, aligned with the tube axis of the column (1), and the relative twist directions of the helical grooves (3), (6) respectively on the column (1) and core (2) are opposite.

When the core (2) is in place within column (1) as shown in FIG. 3, the grooves (3), (6) are in communication at their upper open faces, and form a space between the column (1) and the core (2) which defines a channel (7) which is suitable for the flow of fluid materials (not shown) in a longitudinal direction, as shown by the arrow in FIGS. 1 and 3, through the column (1). The channel (7) has an inlet end at the inlet end (4) of the column (1), and an outlet end at the outlet end (5) of the column (1) for the respective inlet and exit of fluid material into and out of the channel (7).

The helical groove (3) imparts helical flow in a first twist direction (i.e. clockwise) upon the fluid flowing longitudinally along the channel (7) from the inlet end (4) to the outlet end (5), and the groove (6) imparts helical flow in a second twist direction opposite to the first twist direction (i.e. anticlockwise) upon a fluid flowing longitudinally along the channel (7) from the inlet end (4) to the outlet end (5).

The internal cross section of the column (1) tapers from the inlet end (4) toward the outlet end (5), so that internally the column (1) is wider at the inlet end (4) than at the outlet end (5). The external cross section of the core (2) also tapers in a manner generally corresponding to the internal taper of the column (1). The tapering column (1) and core (2) are consequently of a generally frustro-conical shape, with straight sides, and with a cone angle for the taper of 2°–4°.

The depth of the groove (3) in the column (1) is greater in the vicinity of the outlet end (5) of the column (1) than in the vicinity of the inlet end (4). The depth of the groove (3), as measured radially from the upper open face toward the outer surface of the column (1) gradually increases from the inlet end (4) toward the outlet end (5). As the column (1) is internally tapering, the depth of the groove (3) gradually increase in a way corresponding to the taper of the column (1), such that the bottom of the groove (3) lies at the same level throughout its length, lying in a cylindrical surface.

Similarly, the depth of the groove (6) in the surface of the core (2), as measured radially, is greater in the vicinity of the inlet end (4) than in the vicinity of the outlet end (5), the depth gradually decreasing from the inlet end (4) toward the outlet end (5). As the core (2) is externally tapering the depth of the groove (6) gradually decreases in a way corresponding to the taper of the core (2), so that the bottom of the groove lies at the same level throughout its length, lying in a cylindrical surface.

Figure 4:
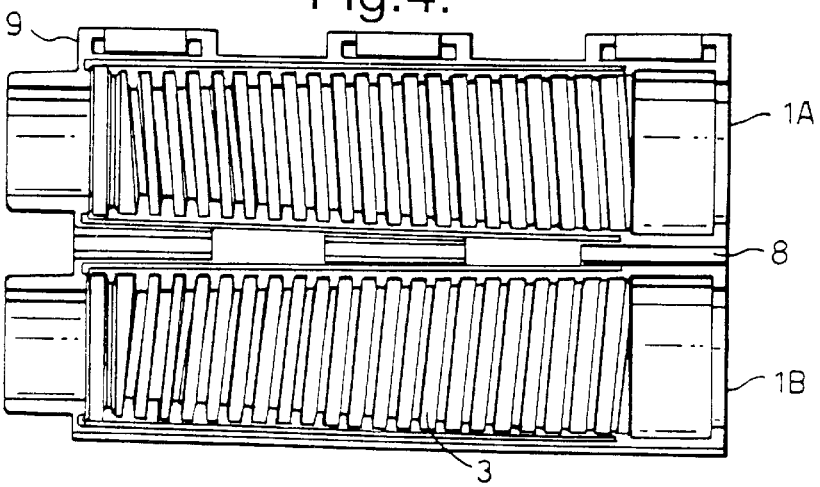
FIG. 4 shows a plan view of the column of FIG. 1 opened about a fold axis.
Figure 5:
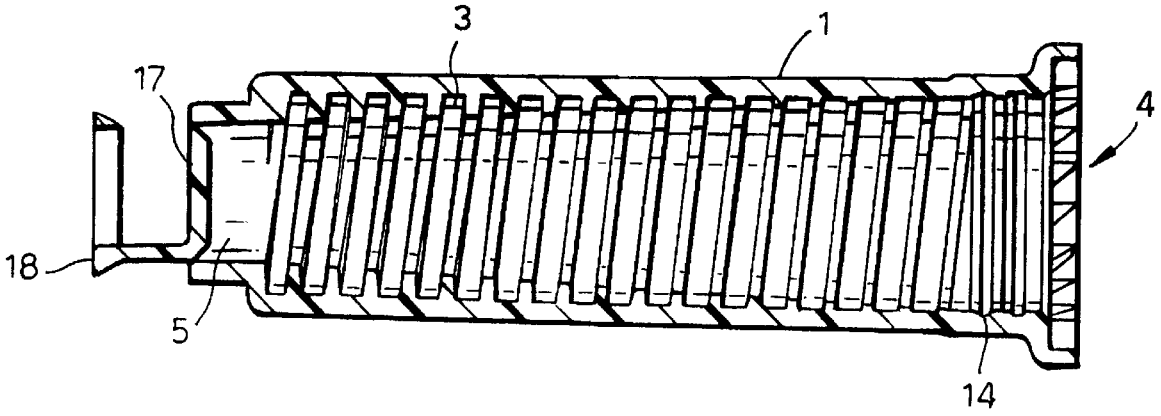
FIG. 5 shows a longitudinal cross sectional view through the column of another mixing device of this invention.
Figure 6:
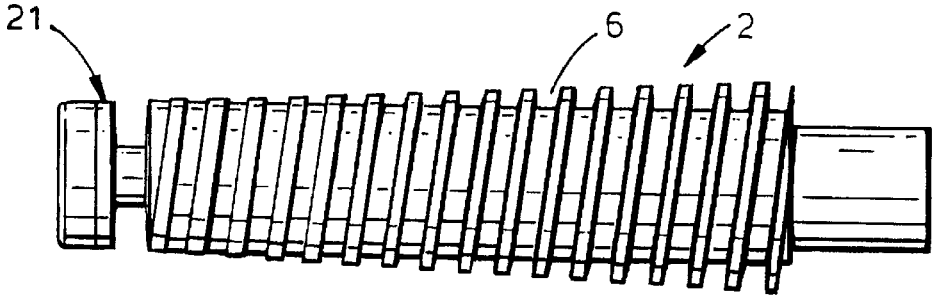
FIG. 6 shows a side view of the core suitable for use with the column of FIG. 5.
Figure 7:
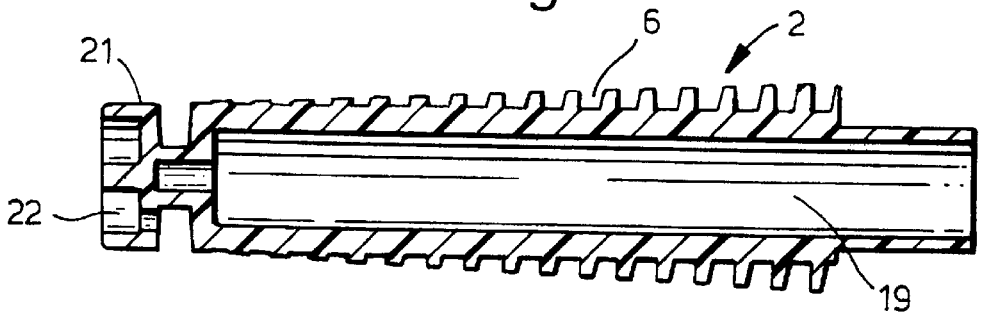
FIG. 7 shows a longitudinal sectional view through the core of FIG. 6.
Figure 8:
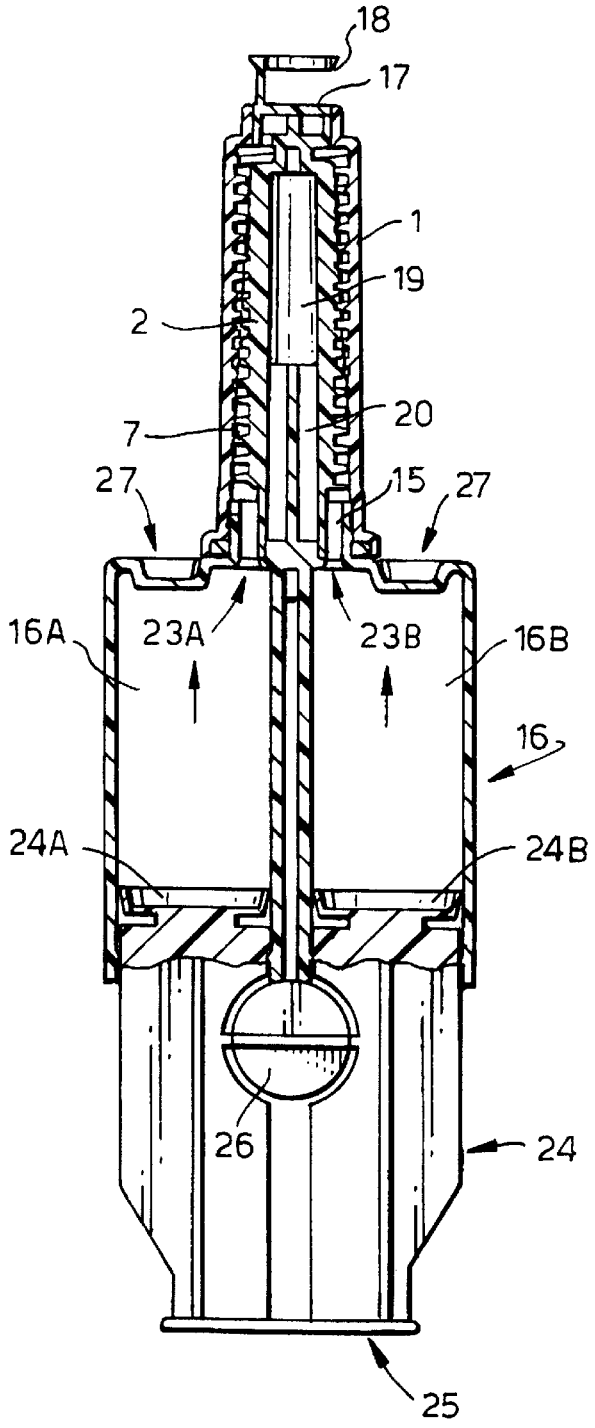
FIG. 8 shows a longitudinal sectional view through a dispensing device incorporating the column and core of FIGS. 5, 6, and 7.

The mixing device of the invention as illustrated in FIGS. 1 to 4 is of multi-part construction. The column (1) is made as a shell, which as shown in FIG. 4 is in two halves (1A, 1B) joined by a film hinge (8) which when closed to form the column are held together by clips (9). A separate core (2) is inserted into the column (1), and is retained in place by integral fins (10), within a collar (11) at the inlet end, there being apertures between the fins (10) for the fluid. At the outlet end the core (2) is retained within the column (1) by a plug (12), again with apertures (not shown) for the fluids.

The mixing device is made as a nozzle-like adapter which may be connected to the outlet channel (13) of a dispenser for two or more fluid materials of the kind discussed above.

At the inlet end (4) of the column (1) two or more fluids may be fed into the column in separate or partly pre-mixed streams, and the considerable turbulence and shear caused in the stream of fluids by the simultaneous imparting of opposite helically twisted flow to the fluids as they flow through the channel (7) causes them to be thoroughly mixed by the time they reach the outlet end (5).

The entire mixing device illustrated in FIGS. 1 to 4 may be made of plastics materials by standard techniques of injection moulding.

Referring to FIGS. 5–8 the overall arrangement is similar to that of FIGS. 1 to 4, and corresponding parts are numbered correspondingly. In the description below, only differences between the parts shown in FIGS. 5–8 and those shown in FIGS. 1–4 are described in detail.

The column (1) is made, in one-part construction, by injection moulding of plastics materials. Near its inlet end (4) the internal surface of the column (1) is provided with grooves (14) which enable a snap-fit connection to corresponding ridges on the neck part (15) of a reservoir unit (16) comprising a pair of side-by-side reservoirs (16A, 16B). At its outlet end (5) the column (1) is provided with a tear-off tamper evident closure disc (17), with a pull ring (18). The disc (17) is linked to the outlet end (5) by only an integral tearable thin film link.

The core (2) is hollow, and has an internal socket (19) allowing engagement with a retaining fin (20) on the reservoir unit (16). At its outlet end the core (1) is provided with a centering flange (21) which fits into the outlet end of the column (1). The flange (21) is pierced by a number of holes (one shown, 22) to allow passage of fluid material through.

Figure 9:
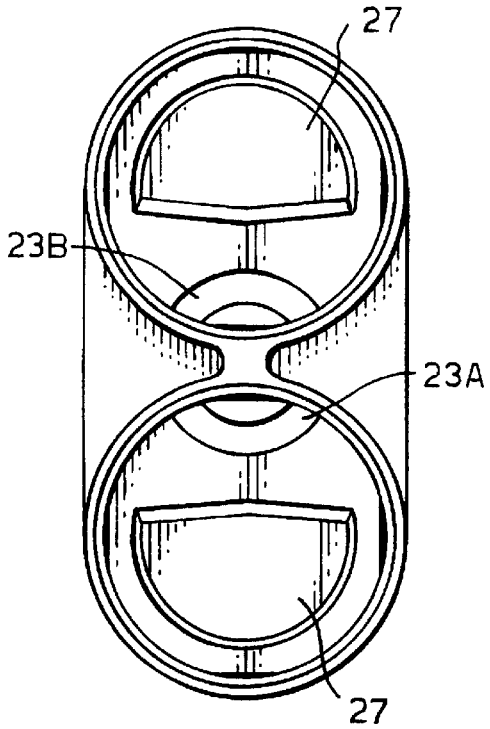
FIG. 9 shows detail of the outlet passages from reservoirs into the mixing device of the invention.

The reservoir unit (16) comprises a pair of side-by-side reservoirs (16A, 16B) linked in an integral construction. The neck part (15) includes outlet passages (23A, 23B) which when the mixing device is in place allow fluid material to flow from each reservoir (16A, 16B) into the inlet end of the channel (7). As shown in FIG. 9, being a view in the direction of the arrows in FIG. 8, each outlet passage (23A, 23B) is part circular, centred about the axis of the column (1).

The reservoir unit (16) is provided with a piston unit (24) comprising two integrally linked pistons (24A, 24B), respectively one in each reservoir (16A, 16B). The piston unit (24) may be pushed in the direction of the arrow by button (25). The internal surfaces of the reservoirs (16A, 16B) are provided with abutment surfaces (not shown) to prevent inadvertent removal of the pistons (16A, 16B). The piston unit (24) includes a tear-off member (26) which prior to use abuts against the reservoir unit (16) to prevent premature operation of the piston unit (24).

In use, the closure disc (17) and member (26) are torn off, and the piston unit (24) may be pushed by hand action applied to button (25) in the direction of the arrows to force fluid material in the reservoirs (16A, 16B) along the channel (7). Convenient finger rests (27) are provided to enable the dispensing device to be used in the manner of a syringe.

What is claimed is:

1. A mixing device which is suitable for mixing two or more fluid materials; comprising a generally tubular column (1), within the column (1) there being an internal longitudinally aligned core (2), with a space between the column (1) and the core (2) defining a channel (7) which is suitable for the flow of the fluid materials in an overall longitudinal direction through the column (1), the channel (7) having an inlet end (4) and an outlet end (5) for the respective inlet and exit of fluid material into and out of the channel (7), the column (1) having an inner surface which faces the core (2), said inner surface having one or more helical grooves thereon having a first twist direction and the core having an outer surface which faces the column (1), said outer surface also having one or more helical grooves thereon having a second twist direction opposite to the first twist direction, the said grooves comprising the channel wherein the depth of the one or more grooves (3) in the column (1) is greater in the vicinity of the outlet end (5) of the column (1) than in the vicinity of the inlet end (4).

2. A mixing device according to claim 1 wherein the tubular column (1) is internally generally circular-sectioned, and the core (2) is also externally generally circular-sectioned, with the core (2) coaxially aligned with the tube axis of the column (1).

3. A mixing device according to claim 1 wherein the internal cross section of the column (1) decreases from the inlet end (4) toward the outlet end (5), so that internally the column (1) is wider at the inlet end (4) than at the outlet end (5), and the external cross section of the core (2) decreases in a manner generally corresponding to the internal decrease in internal cross section of the column.

4. A mixing device according to claim 3 wherein the column (1) and core (2) are of a generally frustro-conical shape, with a cone angle for the taper of 1°–4°.

5. A dispensing device for two or more fluid materials comprising two or more separate storage reservoirs each reservoir having a respective outlet passage, each reservoir containing respective fluid material, each reservoir being provided with displacement means to force the material out through the outlet passage of the reservoir, and a mixing device as claimed in claim 1 being in downstream communication with the outlet passage of each reservoir such that material displaced from the reservoirs enters the mixing device at the inlet end thereof, and from the outlet end of the mixing device the product being the mixed two or more fluid materials may be dispensed.

6. A mixing device which is suitable for mixing two or more fluid materials; comprising a generally tubular column (1), within the column (1) there being an internal longitudinally aligned core (2), with a space between the column (1) and the core (2) defining a channel (7) which is suitable for the flow of the fluid materials in an overall longitudinal direction through the column (1), the channel (7) having an inlet end (4) and an outlet end (5) for the respective inlet and exit of fluid material into and out of the channel (7), the column (1) having an inner surface which faces the core (2), said inner surface having one or more helical grooves thereon having a first twist direction and the core having an outer surface which faces the column (1), said outer surface also having one or more helical grooves thereon having a second twist direction opposite to the first twist direction, the said grooves comprising the channel wherein the depth of the one or more grooves (6) in the surface of the core (2) is greater in the vicinity of the inlet end (4) of the column (1) than in the vicinity of the outlet end (5).

7. A mixing device according to claim 6 wherein the tubular column (1) is internally generally circular-sectioned, and the core (2) is also externally generally circular-sectioned, with the core (2) coaxially aligned with the tube axis of the column (1).

8. A mixing device according to claim 6 wherein the internal cross section of the column (1) decreases from the inlet end (4) toward the outlet end (5), so that internally the column (1) is wider at the inlet end (4) than at the outlet end (5), and the external cross section of the core (2) decreases in a manner generally corresponding to the internal decrease in internal cross section of the column.

9. A dispensing device for two or more fluid materials comprising tow or more separate storage reservoirs each reservoir having a respective outlet passage, each reservoir containing respective fluid material, each reservoir being provided with displacement means to force the material out through the outlet passage of the reservoir, and a mixing device as claimed in claim 6 being in a downstream communication with the outlet passage of each reservoir such that material displaced from the reservoirs enters the mixing device at the inlet end thereof, and from the outlet end of the mixing device the product being mixed two or more fluids may be dispensed.

* * * * *